United States Patent [19]

Franzmann

[11] 4,387,621

[45] Jun. 14, 1983

[54] MANUAL CONTROL LEVER FOR STRINGED INSTRUMENTS

[76] Inventor: Ranier Franzmann, Rehhagweg 9, 7800 Freiburg, Fed. Rep. of Germany

[21] Appl. No.: 183,695

[22] Filed: Sep. 3, 1980

[51] Int. Cl.[3] ..... G10H 3/00

[52] U.S. Cl. ..... 84/1.16; 84/1.27; 84/1.24

[58] Field of Search ..... 84/1.01, DIG. 7, 1.16, 84/1.19, 1.24, 1.27

[56] References Cited

U.S. PATENT DOCUMENTS 3,742,114 6/1973 Barkan ..... 84/1.16

4,281,573 8/1981 Yarema ..... 84/1.27

*Primary Examiner*—J. V. Truhe

*Assistant Examiner*—Forester W. Isen

*Attorney, Agent, or Firm*—Stonebraker, Shepard & Stephens

[57] ABSTRACT

A manual control lever for plucked instruments supplied with electric sound amplification has a rest plate for the player's plucking hand. This rest plate is located above the strings and held by a lever arm which has rotary bearings, allowing a motion parallel to the top and further an up-and-down motion vertical to the top of the instrument. The parallel-to-the-top-motion provides the necessary movability when plucking the different strings of the instrument. The vertical-to-the-top-motion provides a continuous control of sound elements, preferably volume and timbre, through the fact that the mechanical means drive electronic members converting the mechanical movement or pressure into a continuous variation of voltage or current. The volume is controllable in two ranges: Firstly from zero to the normal level, and secondly from normal level to a maximum peak.

15 Claims, 5 Drawing Figures

MANUAL CONTROL LEVER FOR STRINGED INSTRUMENTS

BACKGROUND OF THE INVENTION

This application relates to manual control levers for plucked instruments supplied with electronical equipment for sound amplification or sound embellishment, especially electric guitars and basses. Such manual control levers render possible a continuous control of the tone signal continually when playing.

Manual control levers have been described in the German utility model (gebrauchsmuster) No. 1983 374. The known embodiments of control levers have considerable disadvantages in their mechanical mode of action, thus causing an unsatisfactory playing technique. For a masterly handling of a control lever it is very important that its mechanical members provide control motions which are in a logical and suitable correlation with the other actions exercised by the plucking hand at the same time.

In the contemporary performance of music through electric guitars or basses, foot-pedals are used very often for the control of volume, timbre, and other sound elements. Manual control levers, which may be substituted for those pedals, have to render possible a more precise and smooth control of the mentioned sound elements, thus allowing the performance of very fine sound modulations according to a high musical standard. The control actions or motions should provide an easy playing technique in a convenient correlation to the usual actions of the plucking hand of the person playing the instrument. Performing said sound modulations, the player should be enabled to reinforce the sound characteristics of his instrument or to alter them for new musical expressions.

One can state that the main problem of a satisfactory embodiment of a manual control lever lies in the design and coordination of its mechanical means, rather than in its electronic members which complete the whole device. The electronic members and circuits are readily available in satisfactory form in the large selection of the known art and skill.

One of the objects of the present invention is to provide a manual control lever which renders possible an easy, improved and masterly playing technique of the plucking hand through the form, arrangement and working mode of its mechanical means.

Another object is to provide a manual control lever equally qualified for both plucking techniques, the plectrum and the finger picking.

Still another object is to provide a manual control lever which renders possible a change of the position of the plucking hand, both in the bridge-nut-direction and the transverse direction.

A further object of the invention is to provide a manual control lever which can be turned away from its working position, so that the oscillating part of strings and the bridge are not covered by any mechanical member.

A still further object is to provide a manual control lever with which the attack of the sound signal can be controlled in an easy and effective way.

Yet another object is to provide a manual control lever with which the accent of a tone can be reinforced.

Another object is to provide a manual control lever with which the decay of a tone signal can be reinforced for a longer sustained time.

Still another object is to provide a manual control lever with which sound modulations can be controlled to perform a volume/timbre-vibrato and crescendi or decrescendi.

Yet another object is to provide a manual control lever with which the timbre of the sound can be controlled when playing.

Further objects and advantages of this invention will become apparent from the further description.

SUMMARY OF THE INVENTION

The manual control lever of this invention has a rest plate for loading or pressing by the plucking hand. This rest plate is located above the strings near to the bridge and is held by a lever arm which has rotary bearings, allowing a motion parallel to the top of the instrument, and further has an up-and-down motion vertical or perpendicular to the top of the instrument. The rotary bearings are mounted on the body of the instrument.

The rest plate is held in such a distance above the strings that a convenient plucking is rendered possible. The parallel-to-the-top-motion provides the necessary movability when plucking different strings of the instrument. It also provides the portability of the rest plate into a position from which a finger picking can be done in a convenient way. If wanted, the lever arm can be turned away from the strings into a parked-position so that an unhindered activity of the plucking hand is possible for the performance of a beated rhythm accompaniment or the damping of the strings, just on the bridge, to produce muffled tones.

The rotary bearing for the parallel-to-the-top-motion is so located on the body of the instrument that the motion of the lever arm follows approximately the motion of the forearm of the player. The loaded rest plate will preferably be touched by the palm of the plucking hand. The movable rest plate provides a convenient and advantageous support for the plucking hand, thus improving the normal plucking-or-picking-technique.

The up-and-down or vertical-to-the-top motion of the control lever arm serves for the continuous control of sound elements, preferably volume or/and timbre.

The lever arm with the rest plate is held up in an unoperated position by a tension spring. Loading or pressing the rest plate, the player drives the lever arm against the spring towards the strings. The motion will be stopped by a stop-device which is connected with the lever arm. This stop-device has to stop the lever arm in a precise but also smooth way. The stopping has to be done without noises. The stop-position of the lever arm will be called the normal position. The way or distance from the unoperated position to the normal position is only a few millimeters. If the player loads the rest plate with a convenient pressure, the lever arm will be entirely stopped in the normal position. Continuous increasing of the pressure will cause a further, diminutive motion or alternately the increasing of the load on a special converter which is able to convert different mechanical pressurers into corresponding voltages.

For the first control range, that is from the unoperated position to the normal position, a converter converts the changing position of the lever arm into corresponding voltage changes. If the increased pressure causes a motion beyond the point of the normal position, a second converter may convert this additional changing of position into corresponding voltage changes.

In one embodiment of the invention, these converters work in circuits which conduct directly the sound signal. Alternatively, they produce control voltages in special control circuits to influence the sound signal in a following voltage control arrangement. The latter circuit arrangement is preferred. Both types of electronic sound control are well known in the art and skill.

The most important sound element to be controlled through the manual control lever is the volume of the sound, that is its amplitude. The volume is controllable in two ranges. The first range stretches from the unoperated position of the control lever to the normal position. The second range stretches from the normal position to the extreme position produced by maximum pressure.

In the unoperated position the volume will have the level zero. The volume increases continuously from zero to a normal level which will be achieved in the normal position. The mechanical stop-device enables the player to hold and control the normal level without any difficulty. Enhancing the normal pressure to the maximum pressure, the volume increases from normal level to a maximum level.

These mentioned patterns of the volume control enable the player to control different modulations of volume in a very precise and smooth way. He can alter the normal attack of a plucked sound in the following way: Firstly he diminishes the normal pressure so that the lever arm moves into the unoperated position, then he plucks the string, the sound of which cannot be heard before he drives the lever arm back into the normal position, thus increasing the volume continuously. Such an attack sounds like the typical attack of a wind-instrument.

If the player wants to perform a strong accent he will enhance the pressure suddenly beyond its normal mark or position, and then plucks the string, thus producing a loud and piercing tone.

If the player has to play long notes, he can hold the lever arm in the normal position, pluck the string and then increase the pressure, thereby increasing the volume, thus compensating the decay of the sound signal. Playing in this technique he can hold the tone until the oscillation of the string ceases.

Driving the lever arm, the volume is directly controllable during the whole time of sound performance. So crescendi or decrescendi can be played. If the player drives the lever arm in a oscillating manner a volume-vibrato can be played similar to the volume-vibrato of wind-instruments.

As a second sound element the timbre can additionally be controlled by the manual control lever. The given control voltages can be used to control special circuitries for the variation of timbre. These circuitries are well known in various types.

Regarding acoustic instruments, it is known that the timbre of a sound will change dependent on its volume. The formants change from lower frequency ranges up to higher frequency ranges if volume will be increased. Vivid and interesting sounds need said interdepedence of volume and timbre. For this reason it is an object of the present invention that the timbre can be controlled from a soft and dark to a treble and bright character simultaneously with the volume.

In the unoperated position the timbre may be soft and dark, changing continuously to medium in the normal position, and further to treble and hard at the maximal pressure.

If the manual control lever is not used, it can be turned away from the strings as mentioned above and/or its electronic circuitries can be switched out through a switch which is mounted on the top of the instrument or directly on the lever arm.

The mentioned possibilities of sound modulation achieve their advantageous practicability through the fact, that the necessary control actions are easy to be played and do not disturb the other actions of the player's plucking hand.

These and further advantages and objects of this invention will become apparent from the following description and drawings.

DESCRIPTION OF THE PREFERRED EMBODIMENTS

Figure 1:
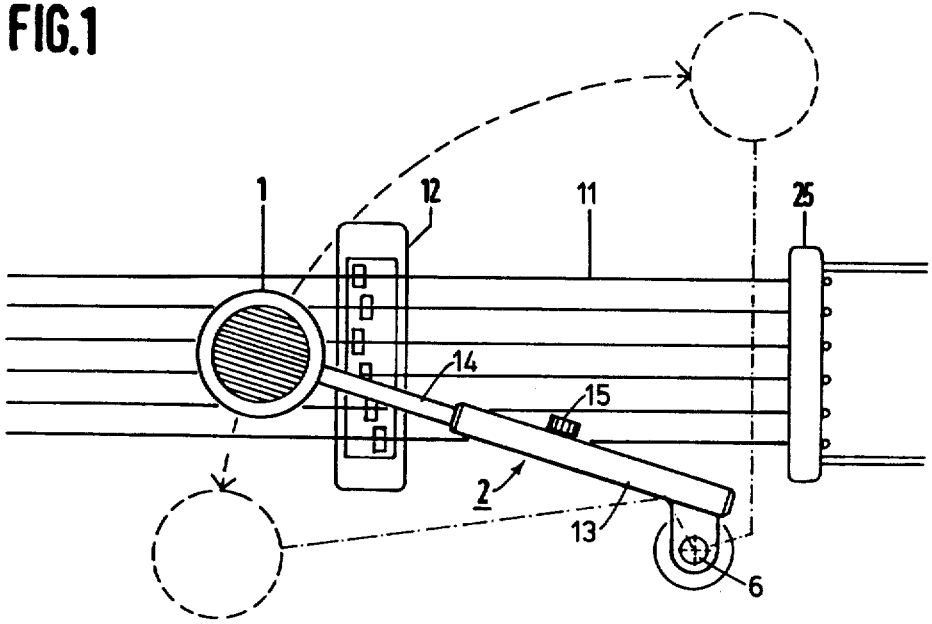
FIG. 1 is a top plan view of a fragment of the instrument, showing the manual control lever in relation to the strings and omitting parts normally not seen because covered by the top of the instrument.
Figure 2:
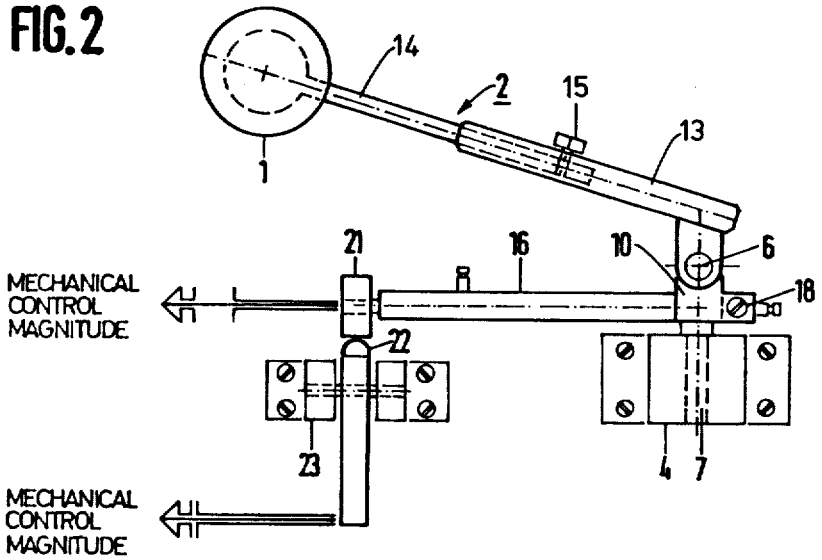
FIG. 2 is a top plan view omitting the strings and the cover of the instrument and showing the parts within the body of the instrument.

The rest plate 1 for loading or pressing by the plucking hand of the player is mounted on the lever arm 2. In this embodiment the rest plate 1 is round-shaped, thus rendering possible a convenient resting of the player's hand, plucking from different positions. Other shapes enabling a convenient handling may also be applied alternately.

The lever arm 2, preferably made of metal and adjustable in length as explained below, is mounted on the body 3 of the instrument by means of the pin or axle 7 extending approximately parallel to the top 5 of the instrument and rotatable in a bearing 4 fixed to the bottom wall 3 of the instrument. This mounting pin 7 renders possible an up-and-down motion of the lever arm 2, vertical or perpendicular to the top 5 of the instrument. The second rotary bearing pin 6 is mounted on the axle 7 perpendicular thereto, and the lever arm 2 swings on this pin 6 in a direction parallel to the top 5 of the instrument. The rotary pin 7 in the bearing 4 can preferably be constructed as a ball-bearing for a precise and smooth mode of action. The rotary bearing 6 has to turn easily, but there must also be enough friction to hold the unloaded lever arm 2 in any position, when the instrument is played in a usual posture. The necessary friction can be gained by the tension force of a spring 8 which pulls the flange 9 on the pin 6 down against the top surface of the housing 10 which is part of the rotary pin 7. Other mechanical means to provide the necessary friction can also be applied alternatively.

When playing, the lever arm 2 and with it the rest plate 1 can be turned above the strings 11 near to the bridge 12. If not used, the lever arm 2 can be turned leftwardly away from the strings 11, or all the way to the right to a position near the stringholder 25, in either position being out of the way so that an unhindered conventional plucking or picking might be done. These two out-of-the-way positions are indicated in broken lines in FIG. 1.

Relating to the different demands of actual players, the position of the rest plate 1 can be adjusted by changing the entire length or extension of the lever arm 2. In this embodiment, the lever arm 2 consists of two parts. Part one is a tubular arm 13 which is connected with the rotary bearing 6. Part two is an extension rod 14 which fits telescopically in said tubular part 13 and is fixed by a lock screw 15 when the desired length of the entire lever arm 2 has been achieved.

The rotary bearings 7 and 6 are located near the usual position of the elbow articulation of the plucking arm, preferably under the top 5, that is inside the body 3 of the instrument. This location provides a movement of the lever arm 2 which follows approximately the motion of the forearm, moved in a parallel-to-the-top plane to change position for the plucking of different strings.

In this embodiment another torque arm or bar 16 is mounted on the housing 10 of the axle 7 for for an up-and-down motion inside the body 3. This bar 16 serves as a stop-device and additionally as a control member.

The lever arm 2 is driven upwards by the tension force of a spring 17 which pulls downward on an extension of the bar 16 on the opposite side of the axle 7 from the rest 1. The tension of the spring 17 can be adjusted through an adjusting screw 18. The upward-motion, that is a movement upwardly away from the top 5, is limited by the spring 19 which pulls downward on the bar 16, and which will be loaded until the sum of all torques around the axle 7 is zero. This position is identical with the "unoperated position" mentioned before. This mode of limitation is very advantageous for an oscillating movement of the lever arm 2.

The downward position of the bar 16 is limited by a stop-flange 20 onto which the bar 16 will be moved. It is important that the stoppage will occur very precisely at an exact point, but not abruptly, and without any noise. The mentioned stop point is identical with the "normal position" mentioned before.

A crank mounted on the body 3 could be connected with the end of the bar 16, the typical motion of which guides the bar 16 smoothly to a precise stop, when the point of return is achieved.

However, in the present preferred embodiment a roll 21 is mounted on the free end of the bar 16. This roll 21 contacts a console 22 which serves as a guide track or way when the bar 16 is moved. The guiding or rolling track of the console 22 is shaped in such way that a straight part changes continuously into a circular part, the radius of which is a little bit larger than that of the roll 21. Starting from the "unoperated position" the roll 21 contacts the straight part and, after a few millimeters, it arrives on the circular curve, where it will be stopped. This mode of stopping is very smooth and precise, just as required above. To avoid the generation of noises the roll 21 is coated with an elastic material such as rubber or plastic.

The console 22 itself is mounted on a rotary bearing 23 allowing the console 22 to be tilted. A spring 24 holds the console 22 in a normal, untilted position. The spring 24 is strong enough that it will not be compressed if the lever arm 2 is loaded by the normal weight or pressure of the player's arm. If the player increases the pressure on the rest plate 1 the spring 24 can be compressed a very little way, thus allowing the tilting of the console 22.

The application of a tilting console is only one possibility. Alternatively the roll 21 may be rotatable on the end of the bar 16, allowing a tilting of the axle of the roll 21. In this case the console 22 could be mounted immovably on the body 3.

The important aspect of this part of the invention is that the down-motion of the lever arm 2 consist of two parts. Firstly the lever arm 2 has to be movable over a distance of a few millimeters as easily as possible. That easy movement will be stopped at an exact point and the further, secondary movement is to be done against the mechanical resistance of an elastic member, allowing only the achievement of a very little, additional way. To stop the first movement at an exact point ensures and enables the player to play very stable and conveniently in the "normal position."

As already mentioned, the control lever motions may be used to control sound volume, or timbre, or other sound characteristics. The first part of the down-motion, started from the "unoperated position" and ending in the "normal position", is applied for the control of the volume from zero to the normal level, if the volume is the factor concerned. If the timbre is the factor to be controlled, this first part of motion preferably controls the range from a dark and soft timbre to a medium and clear one. The second part of the down-motion started from the "normal position" is applied for the control of the volume from the normal level up to a maximum peak, if the volume is concerned. Regarding the timbre, this second part of motion preferably controls the range from a medium and clear to a hard and treble timbre.

The change or converting of the mechanical displacements into corresponding electric values can be achieved through various different electric members and circuit arrangements which are well known in the art and skill, and the exact details thereof are not part of the present invention.

For the control of both the volume and timbre, special potentiometer may be arranged to produce an analogous, passive change of the electric resistance, directly in the sound signal circuit.

Those arrangements have some disadvantages concerning especially the generation of unwelcome noises and further the uncertainty and lack of durability of their electronic members, if the control actions are done permanently or very often, just as expected.

To avoid these disadvantages, the preferred embodiment of the invention has special, active circuits for the generation of electric control signals on the basis of their own separate voltage supply. The control signals can be formed as an analogous or digital value. In this example the arrangement of circuits for analogous values of voltages is the preferred embodiment.

Figures 3, 4:
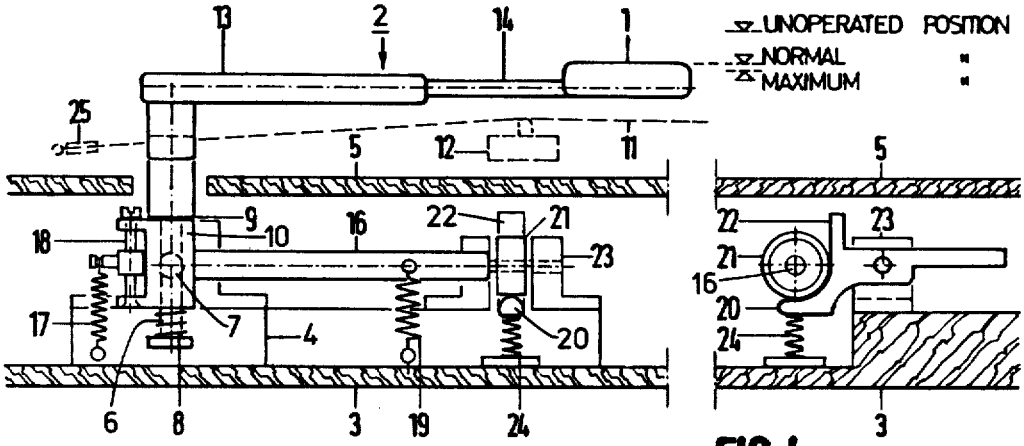
FIG. 3 is a vertical section taken longitudinally through a fragment of the instrument, showing the control lever and associated parts in elevation.
FIG. 4 is a similar sectional view taken transversely, showing the stop-device in elevation.
Figure 5:
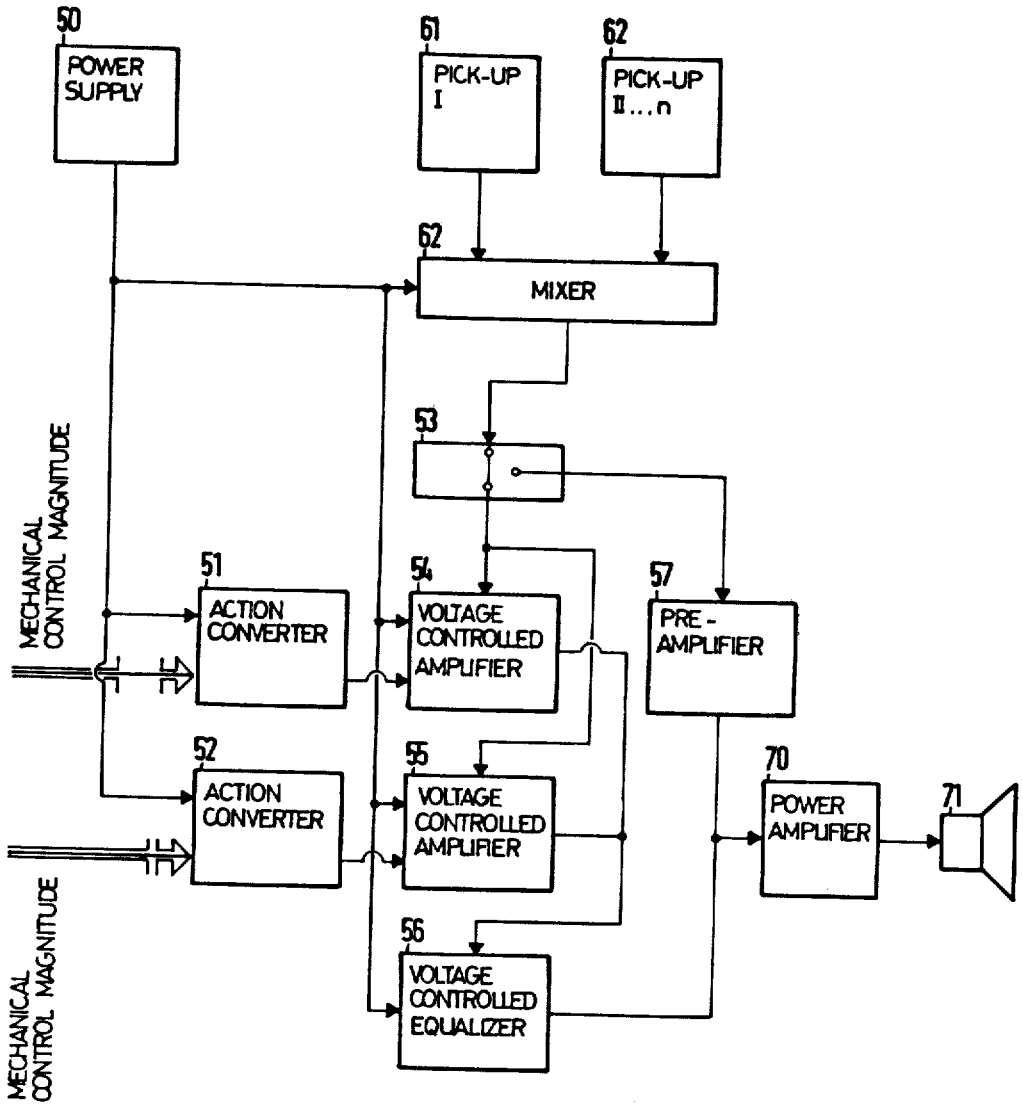
FIG. 5 is a block diagram of the electric circuit arrangement.

FIG. 3 shows in block diagram form the principal parts of an arrangement of the main electronic members or devices. The "power supply" 50 for the "action converters" 51 and 52 is given by mains voltage or battery cells. The action converters 51 and 52 convert the mechanical control magnitude into a corresponding electric control signal, here a value of voltage.

In this embodiment, the converting is done in such a way that a current of light will be changed continuously, influencing a photocell or a photo-electric resistor to produce the desired control value. The continous variation of the current of light can be done by a diaphragm being regulated through the motion of the bar 16 and/or the console 22. Alternatively the light radiation may be deflected via a mirror tilted by the motion of the bar 16 and/or the console 22 thus turning more or less light on said photocell or the photo-resistor. The mechanical and electronical arrangement of such devices are well known in the art.

For the first part of the up-and-down motion from the "unoperated position" to the "normal position," the action converter 51 produces continuously changing values of voltage to influence and control a voltage controlled amplifier 54 and/or a voltage controlled equalizer 56. The voltage controlled amplifier 54 is a well known arrangement for the control of the volume of a sound, here from zero to a medium or normal level. The voltage controlled equalizer is a known arrangement for the control of the formants such as the timbre of a sound, and serves here for timbre variation, from soft and dark to medium and clear.

The separation of the first control range from the second is advantageous, because the "normal position" demands a rather stable or steady control value to ensure a stable, normal sound, not to be changed by an unintentional movement of the lever arm 2. This task can be performed sufficiently if the mentioned part of a control range is at the end of the entire control range.

For the second range, that is from the normal position to the maximum position, the action converter 52 produces continuously changing values of voltages to influence and control the voltage controlled amplifier 55 and/or the voltage controlled equalizer 56. The voltage controlled amplifier 55 provides the control of volume from the medium or normal level to a maximum peak. The voltage controlled equalizer 56 serves for the variation of timbre from medium and clear to treble and hard, done by emphasizing the formants from medium to higher frequency ranges.

If the manual control lever is used, the sound signal, generated by the pick ups 60 and/or 61, 62, runs from the mixer via the voltage controlled amplifiers and equalizers to a normal power amplifier 70 and further to the loud speaker 71. Using the switch 53 the sound signal will be conducted directly to the power amplifier 70 and the manual control lever will be entirely out of function. This switch 53 is placed on the top 5 of the instrument, a short distance from the playing position of the plucking hand. The sound signal is conducted via a pre-amp 57 to increase the amplitude on normal level.

The action converters are placed in the instrument, while device for power supply and the voltage controlled amplifiers and equalizers can be placed in the instrument as well as in a special, separate box or in the housing of the power amplifier. In another embodiment the action converter 52 may be arranged as an electric-conducting material which changes its electric resistance through a continuous change of mechanical strain. This embodiment has the advantage that the second motion is nearly zero and the normal position is very stable.

As a further feature the rest-plate 1, being a hollow case, may support a slide rheostat to produce a continuous control signal when the knob of the rheostat is to be moved in the direction of the axis of the lever arm 2. This control signal may be used for the control of timbre, reverb, or any continuous changeable sound element.

What is claimed is:

1. A stringed musical instrument having a body, strings extending over a portion of said body and arranged to be engaged by fingers on a hand of a person to vibrate the strings to produce sound, a control lever mounted on said instrument body, (a) said control lever having a hand rest portion on which a player's hand may rest while the fingers of such hand engage said strings, (b) said lever being swingably mounted on said instrument body for swinging movement of said hand rest portion both in a direction across said strings at an elevation above them and in a direction upwardly farther above and downwardly closer to said strings, (c) the upward and downward swinging movement of said lever being through a first range from an uppermost unoperated position to an intermediate normal position and a second range from said normal position farther downwardly to a lowermost maximum position, (d) means tending to raise said lever to said unoperated position and resisting downward motion from such position, (e) motion-resisting stop means determining said normal position and providing additional resistance to downward motion when said lever reaches said normal position, so that greater downward pressure on said hand rest portion is required to move said lever downwardly through its second range than the pressure required to move it downwardly through its first range, and (f) electronic sound converter means responsive to said upward and downward swinging movement of said lever for controlling an element of the sound heard as a result of playing said strings.

2. The invention defined in claim 1, wherein said element is the loudness of the sound.

3. The invention defined in claim 1, wherein said element is the timbre of the sound.

4. The invention defined in claim 4, wherein the length of said lever is adjustable.

5. The invention defined in claim 1, wherein said stop means includes a circular member guided along a straight portion of a track to a curved portion of the track which cooperates with the circular member to stop the movement of said lever at said normal position.

6. The invention defined in claim 5, wherein said track is displaceable to allow additional movement of said lever from its normal position to its maximum position.

7. The invention defined in claim 1, further comprising oppositely acting springs operatively connected to said lever to tend to hold it in its unoperated position.

8. The invention defined in claim 1, wherein said lever is mounted for swinging movement across the strings about a rotary bearing located close to a usual position of elbow articulation of the plucking arm of a person playing the instrument.

9. The invention defined in claim 1, wherein said lever is mounted for swinging movement across the strings about a rotary bearing having sufficient friction to prevent movement of said lever across the strings as a result of gravity alone.

10. The invention defined in claim 1, further comprising electric circuit means with action converters for controlling a level of sound loudness responsive to the position of said control lever, continuously from a level of substantially zero when said lever is in its unoperated position to a medium level when said lever is in its normal position and to a maximum peak value when said lever is in its maximum position.

11. The invention defined in claim 1, further comprising electric circuit means responsive to the position of said control lever for continuously controlling the timbre of sound signals produced by playing the instrument, from soft and dark when said lever is in its unoperated position to medium and clear when said lever is in its normal position and to treble and hard when said lever is in its maximum position.

12. The invention defined in claim 1, wherein said second range of movement of said lever is of relatively small extent, and said first range is of much greater extent than said second range.

13. The invention defined in claim 1, wherein said means tending to raise said lever, and said stop means, are of such dimensions that the weight of a player's hand resting on said hand rest portion of said lever, without purposeful downward force exerted thereon, will move said lever downwardly no farther than its said normal position, purposeful additional force being required to move said lever into its second range.

14. The invention defined in claim 1, wherein said hand rest portion is in the form of an approximately circular plate portion on a free end of said lever.

15. The invention defined in claim 1, wherein said electronic sound converter means includes sound amplifier means controlled by a variable voltage, and includes means responsive to movement of said lever through its said first range for varying such voltage between substantially zero and a predetermined intermediate value and responsive to movement through its said second range for varying such voltage between said predetermined intermediate value and a maximum value.

* * * * *